US007206382B2

(12) United States Patent
Besana

(10) Patent No.: US 7,206,382 B2
(45) Date of Patent: Apr. 17, 2007

(54) DEVICE FOR ADJUSTMENT OF THE ANTI-SCATTERING GRID TO THE FOCAL LENGTH FOR RADIOLOGICAL EQUIPMENT

(75) Inventor: Luigi Besana, Monza (IT)

(73) Assignee: Mecal S.R.I., Milan (IT)

( * ) Notice: Subject to any disclaimer, the term of this patent is extended or adjusted under 35 U.S.C. 154(b) by 51 days.

(21) Appl. No.: 10/512,394

(22) PCT Filed: Jun. 23, 2003

(86) PCT No.: PCT/IT03/00385

§ 371 (c)(1),
(2), (4) Date: Oct. 22, 2004

(87) PCT Pub. No.: WO2004/013866

PCT Pub. Date: Dec. 2, 2004

(65) Prior Publication Data

US 2005/0152500 A1 Jul. 14, 2005

(51) Int. Cl.
*G21K 1/00* (2006.01)

(52) U.S. Cl. ..... 378/145; 378/150; 378/154; 378/155

(58) Field of Classification Search ..... 378/147, 378/149, 150, 154, 155, 145; 250/505.1; 72/404, 414, 415; 100/295
See application file for complete search history.

(56) References Cited

U.S. PATENT DOCUMENTS 3,919,559 A * 11/1975 Stevens ..... 378/154
5,291,539 A 3/1994 Thumann et al. ..... 378/154
6,415,017 B1 * 7/2002 Kohda ..... 378/154
6,594,878 B2 * 7/2003 Kohda ..... 29/417

FOREIGN PATENT DOCUMENTS

DE 43 05 475 C1 2/1993

OTHER PUBLICATIONS

Patent Abstracts of Japan,Koda Katsuhiro, Scattered-Beam Eliminating Grid, Grid Apparatus, and Manufacture of Scattered-Beam Eliminating Grid, Application No. 11018561, Application Date Jan. 27, 1999, Publication No. 2000217813, published on Aug. 8, 2000.

* cited by examiner

*Primary Examiner*—Allen C. Ho
(74) *Attorney, Agent, or Firm*—Lucas & Mercanti, LLP

(57) ABSTRACT

A device for the adjustment of the anti-scattering grid (G) of a radiological equipment to the different focal lengths that said equipment can provide includes a pair of pressing members (P) mobile in the direction transverse with respect to the plane of the grid (G), which is arranged and restrained between said pressing members (P) and a pair of corresponding underlying contrast members (C), the convex/concave profile of each pair of members (P, C) being obtained as locus of the local deformations, calculated point by point with a suitable spatial resolution, necessary to adjust the orientation of the segments of the grid (G) when going from one reference focal length to a second focal length.

19 Claims, 3 Drawing Sheets

DEVICE FOR ADJUSTMENT OF THE ANTI-SCATTERING GRID TO THE FOCAL LENGTH FOR RADIOLOGICAL EQUIPMENT

This patent application claims the benefit of priority from Italian Patent Application No. MI2002A 001763 filed Aug. 2, 2002 through PCT Application Ser. No. PCT/IT03/00385 filed Jun. 23, 2003, the contents of each of which are incorporated herein by reference.

The present invention relates to radiological equipments, and in particular to a device for the adjustment of the anti-scattering grid to the different focal lengths that a radiological equipment can provide.

It is known that in radiological examinations involving significant amounts of matter there is generated a diffuse radiation which negatively affects the formation of the radiological image, since it generates an information not directly in correlation with the anatomic/morphologic structure of the part under examination.

Being not possible to eliminate the scattering since it is an intrinsic effect of the interaction of X-rays with matter, there are used anti-scattering grids which reduce the diffuse radiation which would reach the detector. Presently known grids are fixed focused grids, i.e. grids built with segments oriented along a certain angle specific for a focal length, which can be used only at the design length or at most for a limited range of focal lengths around the nominal focal length. Outside this range the grid is not usable in that it does no longer allow the transmission of the main radiation in a percentage useful for the formation of the image.

For equipments with a wide range of the focus-detector distance, e.g. from 100 cm to 180 cm, the need arises to provide at least two grids and to allow the change of grid according to the type of examination, namely to the focal length set on the equipment. The grid change implies a double drawback both for the decrease in the intrinsic efficiency of the equipment and for the safety of the population, in terms of erroneous exposures.

In other words, the fact of having to change the grid when the focal length is modified dilates the times for carrying out the radiographies and thus reduces the productivity of the equipment, besides involving the additional space taken up by the unused grid and possible difficulties of change by inexperienced operators. Moreover, if the operator does not change the grid this jeopardizes the result of the examination, thus leading to a useless exposure of the patient who will have to repeat the examination.

The first of these drawbacks is particularly limiting in the case of the modern equipments for digital radiology, characterized by a potentially high productivity thanks to the use as detector of a single digital detector (of the type with diodes and scintillator) suitable for examinations both at short and long focal length and even without the presence of the grid.

Therefore the object of the present invention is to provide a device which overcomes the above-mentioned drawbacks.

This object is achieved by means of a device which bends the grid to adjust it when the focal length is modified. Other advantageous features are disclosed in the dependent claims.

The main advantage of the present device is exactly that of dispensing with the grid change when the focal length is modified, so as to minimize the setup time of the equipment for a different examination and to optimize its exploitation.

In this way there is no space taken up by the second grid, the operator has no difficulties in changing the focal length and it is always possible to have an optimal control of the scattering within the grid adjustment range.

In fact, rather than being satisfied with the fact that the distance is within the range in which the grid can be used, the latter is specifically adjusted to the focal length set on the equipment. For example, a grid focused at 130 cm can usually be utilized for distances between 110 and 150 cm, but thanks to the present device it can be precisely adjusted for distances between 130 and 150 cm with the range of use extended up to 180 cm.

Another significant advantage stems from the fact that the grid adjustment can be easily made automatic and correlated with the setting of the focal length, whereby there is no longer the risk of the operator forgetting it and the good outcome of the examination is sure.

These and other advantages and characteristics of the device according to the present invention will be clear to those skilled in the art from the following detailed description of an embodiment thereof, with reference to the annexed drawings wherein.

Figure 1:
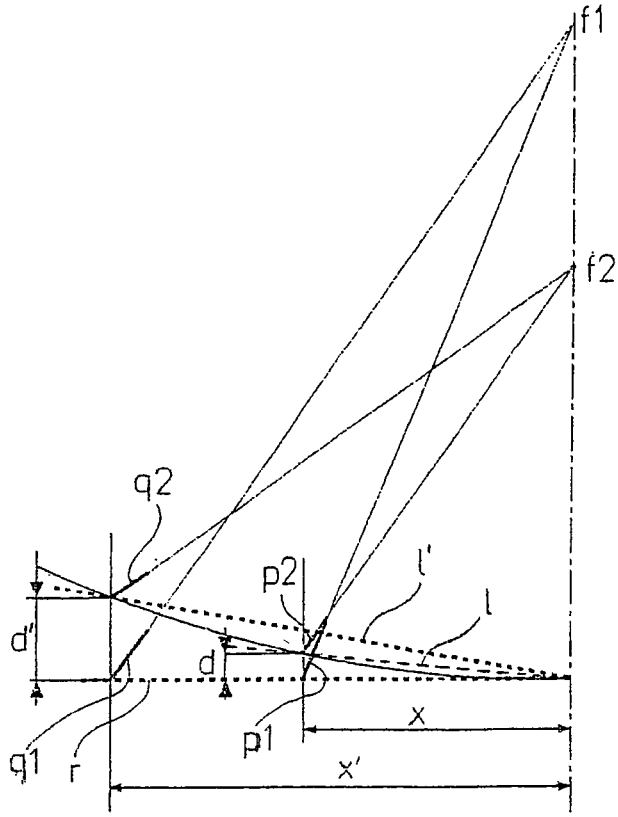
FIG. 1 is a diagram showing the principle of the adjustment of the grid upon modification of the focal length.

Starting from the diagram of FIG. 1, there is first illustrated the principle on which the operation of the present grid adjustment device is based.

Indicating with f1 a first longer focal length and with f2 a second shorter focal length, with p1, q1 and p2, q2 there are indicated the orientations required for said respective focal lengths to two segments located respectively at x and x' distance from the focal axis which coincides with the midplane of the grid, the latter being indicated by the dotted reference line r.

To go from p1 to p2 the reference line r, i.e. the grid, should rotate to the position corresponding to the dotted line 1, whereas to go from q1 to q2 it should rotate to the position of the dotted line 1'. As clearly shown by said diagram, the grid should therefore rise at a height d at distance x, which height d is much smaller than the height resulting at line 1' required to obtain a height d' at distance x'.

This means that a rigid rotation of the grid is inadequate, as well as a mere translation, and it is necessary that the grid takes a profile defined as locus of the local deformations d, d', etc. calculated point by point with a suitable spatial resolution. A specific example of such a calculation is illustrated further on, while now the general structure of the device and its simple yet effective operation will be illustrated.

With reference to FIGS. 2 to 6, there is seen that a device according to the present invention essentially consists of a pair of contoured pressing members P mobile in the direction transverse with respect to the plane of the grid G, which is arranged between these elements P and corresponding underlying contrast members C.

Figure 4:
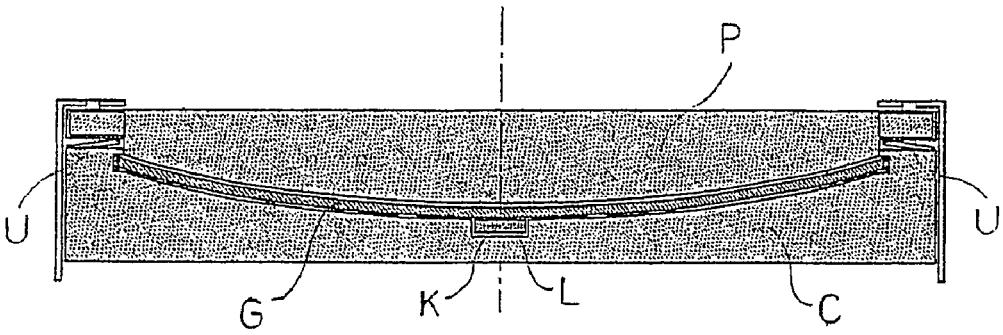
FIG. 4 is a view similar to the preceding one with the device activated.
Figure 6:
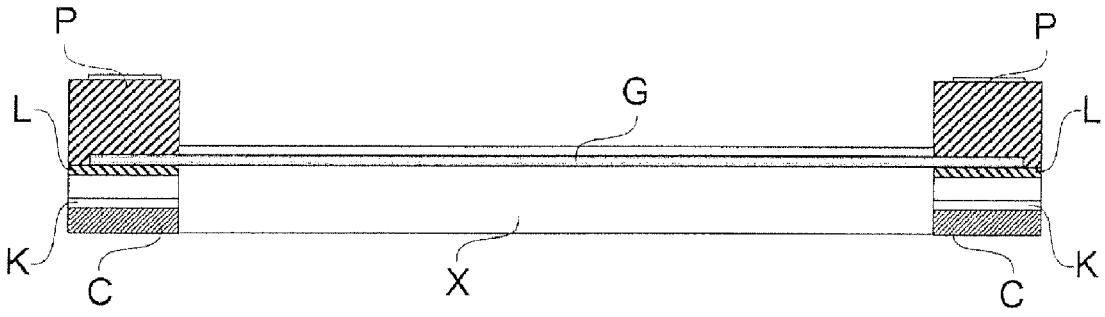
FIG. 6 is a longitudinal vertical section along line VI—VI of FIG. 3 of the grid mounting system.

More specifically, grid G is inserted in guides formed on the inside at the top of the contrast members C and is also centrally secured to pressing members P through plates L screwed thereon from below, as better illustrated in the detail of FIG. 6. To make up for the thickness of plates L, in members C there are formed corresponding recesses K suitable to receive plates L (FIG. 4).

Figure 5:
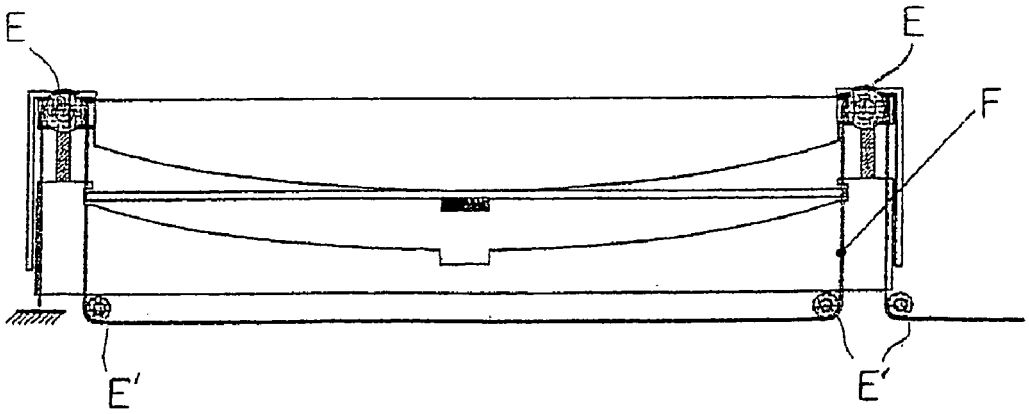
FIG. 5 is a diagrammatic front view showing a possible driving system for the device.

Between the pressing P and contact C members there are return springs U whose resistance must be overcome to operate the device, and which are then used to return it to its rest position. FIG. 5 illustrates a driving system by means of a cable F passing over pulleys E, E' respectively arranged on members P, C so that by pulling on cable F said elements are brought near and by releasing it springs U return them to the rest position. Obviously the pull on the cables, one for each pair of members P and C, will be exerted by means of a motorized drum provided with an end stop both in the opening and closing direction and controlled in correspondence with the setting of the focal length.

It should be noted that the scheme of FIG. 5 is merely indicative of the type of drive, in that actually the push on the pressing members P does not take place directly through pulleys E, E' but rather through members (not shown) carrying said pulleys B and vertically sliding on a fixed structure on which pulleys E' are mounted. This in necessary to allow the removal of grid G in the case of examinations which do not require it, whereby the group of grid G, pressing members P and contrast members C (connected through crossbars X, see FIG. 6) forms a rcmovable frame.

Figure 2:
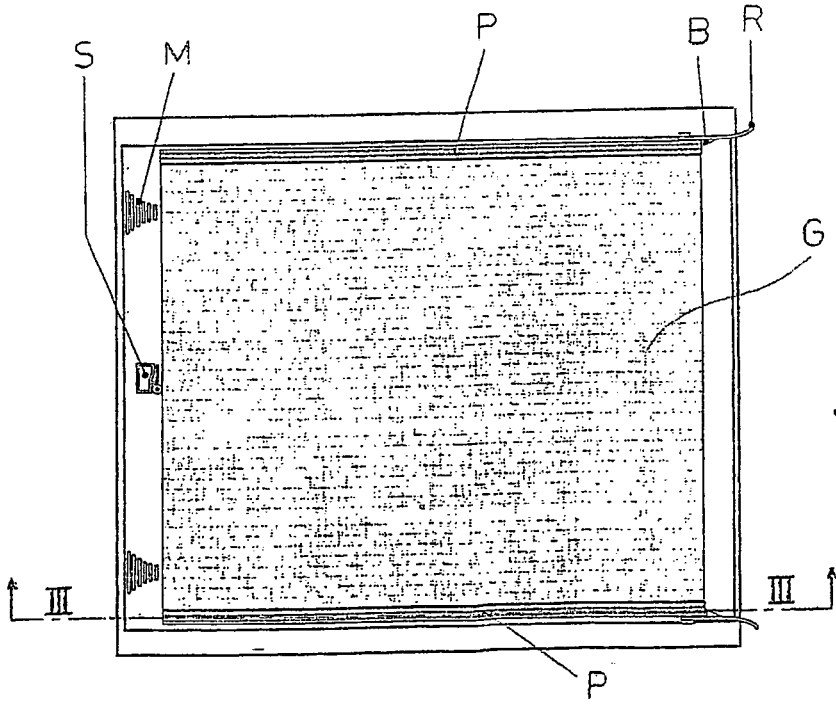
FIG. 2 is a top plan diagrammatic view of the present device.
Figure 3:
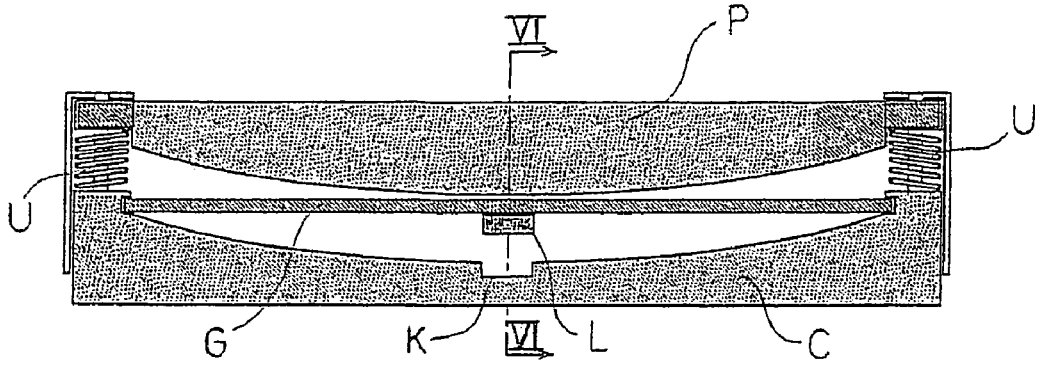
FIG. 3 is a diagrammatic view in vertical section along line III—III of FIG. 2, with the device in the rest position.

This possibility of removal of grid G is diagrammatically illustrated in FIG. 2, which shows retaining clips R carrying blocking teeth B for mounting said frame on said fixed structure. The presence of the grid is also detected by a suitable sensor S, while its position in abutment on teeth B is guaranteed by biasing springs M which also make easier its removal when clips R are widened to disengage the removable frame.

In the table hereunder there is now illustrated an example of a specific calculation of the deformations at a plurality of points along the grid, where with alpha1 and alpha2 there are indicated the angles (in radians) which the segments must have respectively for a focal length f1 of 150 cm and for a length f2 of 130 cm, and with δ their difference from which the required local deformation is obtained. It should be noted that although the table includes the calculations only at a few points, the actual resolution of calculation is in the order of 5 mm whereby the profile of members P, C is obtained with such a resolution and then joining the points thus calculated.

| x [mm.] | alpha1 [rad] | alpha2 [rad] | δ [rad] | tan δ | y = x * tan δ [mm] |
|---|---|---|---|---|---|
| 0 | 0 | 0 | 0 | 0 | 0 |
| 30 | 0.033321 | 0.038443 | -0.00512 | -0.00512 | 0.15 |
| 80 | 0.053283 | 0.061461 | -0.00818 | -0.00818 | 0.65 |
| 100 | 0.066568 | 0.076772 | -0.0102 | -0.0102 | 1.02 |
| 120 | 0.07983 | 0.092047 | -0.01222 | -0.01222 | 1.47 |
| 140 | 0.093064 | 0.107279 | -0.01422 | -0.01422 | 1.99 |
| 160 | 0.106265 | 0.122461 | -0.0162 | -0.0162 | 2.59 |
| 180 | 0.119429 | 0.137587 | -0.01816 | -0.01816 | 3.27 |
| 200 | 0.132552 | 0.152649 | -0.0201 | -0.0201 | 4.02 |
| 210 | 0.139096 | 0.160155 | -0.02106 | -0.02106 | 4.42 |
| 220 | 0.145628 | 0.167642 | -0.02201 | -0.02202 | 4.84 |
| 230 | 0.152148 | 0.175111 | -0.02296 | -0.02297 | 5.28 |

Figure 7:
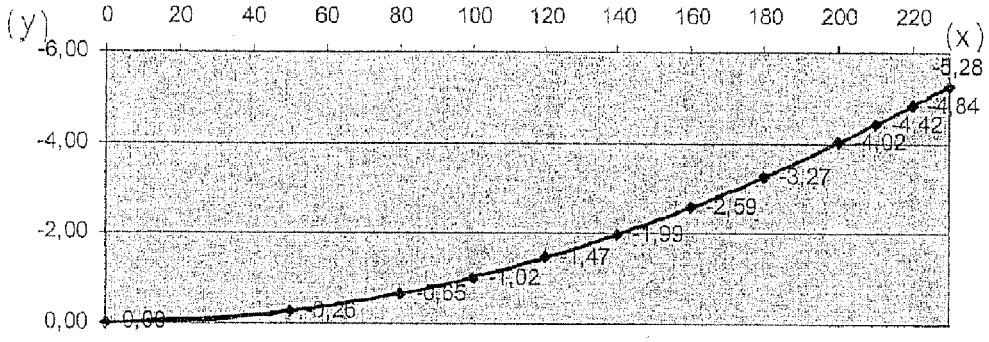
FIG. 7 is a Cartesian chart with the data relating to a specific embodiment of the device.

In the chart of FIG. 7 there is shown the deformation line obtained by connecting these calculated points and which can be approximated by a parabolic curve having the equation:

$$y=-0.0001x^2-0.0006x+0.0082$$

Clearly with a curve of higher order it would be possible to achieve an even better approximation, but as previously explained such a curve has a merely indicative purpose since the actual embodiment of the device provides the use of the real values point by point.

It is clear that the above-described and illustrated embodiment of the device according to the invention is just an example susceptible of various modifications. In particular, the device driving system may be of any kind, e.g. with hydraulic, pneumatic or electric actuators, possibly dispensing with springs U, and similarly the systems for retaining grid G between members P, C and the whole removable frame within the fixed structure may be somewhat changed by using other mechanically equivalent components.

Furthermore it should be noted that the device could also be reversed if it is desired that the grid is undeformed at the shorter focal length and deformed at the longer one. In other words, in this case the pressing member P would be concave and would carry grid G whereas the contrast member C would be convex and centrally connected to the grid through a plate, i.e. the device would in practice be rotated through 180° around a horizontal axis.

Finally, it is obvious that the specific values indicated for exemplificative purpose are non-limiting in that the deformation profile will change according to the reference focal length adopted and to the amount of the difference between the two focal lengths.

The invention claimed is:

1. Device for an adjustment of an anti-scattering grid (G) of a radiological equipment to different focal lengths (f1 f2) that said equipment can provide, characterized in that it includes a first pressing member (P) located at a first end of the device and a second identical pressing member (P) located at an opposite end of the device, both said pressing members (P) being mobile in the direction transverse with respect to the plane of the grid (G), which is arranged and restrained between said pressing members (P) and a pair of identical corresponding underlying contrast members (C) located respectively under said first and second pressing members (P), and in that each pair of pressing members (P) and contrast members (C) has a convex/concave profile corresponding to the locus of the local deformations (d, d', . . . ), calculated point by point with a suitable spatial resolution, necessary to adjust the orientation of the segments of the grid (G) when adjusting the grid (G) to go from a first focal length (f1) taken as a reference to a second focal length (f2).

2. Device according to claim 1, characterized in that the reference focal length (f1) is longer than the second focal length (f2) and the pressing (P) and contrast (C) members respectively have a convex profile and a concave profile.

3. Device according to claim 1 or 2, characterized in that the concave profile member is adapted to secure the grid (G) by introducing the grid (C) into lateral end guides, and in that the convex profile member is adapted to secure the grid (G) by means of a central plate (L) which enters a corresponding recess (K) formed on said concave member.

4. Device according to claim 3, characterized in that return springs (U) are arranged between the pressing member (P) and the contrast member (C).

5. Device according to claim 3, characterized in that the driving of the device is achieved by means of cables (F), one for each pair of members (P, C), passing over pulleys (E, E') suitable to transmit a pressing action to the pressing members (P), the pull on said cables (F) being exerted by a motorized drum provided with end stops both in the device closing and opening direction.

6. Device according to claim 3, characterized in that the contrast members (C) are connected by crossbars; and the grid (G), the pressing members (P) and the contrast members (C) connected by said crossbars form a removable frame introduced into a fixed structure and blocked therein by a retention system.

7. Device according to claim 6, characterized in that the retention system of the removable frame consists of retaining clips (R) carrying blocking teeth (B), the position of the frame in abutment on said teeth (B) being guaranteed by biasing springs (M) also suitable to make easier the removal of the frame when said clips (R) are widened to disengage it.

8. Device according to claim 1 or 2, characterized in that return springs (U) are arranged between the pressing member (P) and the contrast member (C).

9. Device according to claim 8, characterized in that the driving of the device is achieved by means of cables (F), one for each pair of members (P, C), passing over pulleys (E, E') suitable to transmit a pressing action to the pressing members (P), the pull on said cables (F) being exerted by a motorized drum provided with end stops both in the device closing and opening direction.

10. Device according to claim 8, characterized in that the contrast members (C) are connected by crossbars and of the grid (C), the pressing members (P) and the contrast members (C) connected by said crossbars form a removable frame introduced into a fixed structure and blocked therein by a retention system.

11. Device according to claim 10, characterized in that the retention system of the removable frame consists of retaining clips (R) carrying blocking teeth (B), the position of the frame in abutment on said teeth (B) being guaranteed by biasing splings (M) also suitable to make easier the removal of the frame when said clips (R) are widened to disengage it.

12. Device according to claim 1 or 2, characterized in that the driving of the device is achieved by means of cables (F), one for each pair of members (P, C), passing over pulleys (E, E') suitable to transmit a pressing action to the pressing members (P), the pull on said cables (F) being exerted by a motorized drum provided with end stops both in the device closing and opening direction.

13. Device according to claim 5, characterized in that the contrast members (C) are connected by crossbars and the grid (G), the pressing members (P) and the contrast members (C) connected by said crossbars form a removable frame introduced into a fixed structure and blocked therein by a retention system.

14. Device according to claim 13, characterized in that the retention system of the removable frame consists of retaining clips (R) carrying blocking teeth (B), the position of the frame in abutment on said teeth (B) being guaranteed by biasing springs (M) also suitable to make easier the removal of the frame when said clips (R) are widened to disengage it.

15. Device according to claim 1 or 2, characterized in that the contrast members (C) are connected by crossbars (X); and of the grid (G), the pressing members (P) and the contrast members (C) connected by said crossbars (X) form a removable frame introduced into a fixed structure and blocked therein by a retention system.

16. Device according to claim 15, characterized in that the retention system of the removable frame consists of retaining clips (R) carrying blocking teeth (B), the position of the frame in abutment on said teeth (B) being guaranteed by biasing springs (M) also suitable to make easier the removal of the frame when said clips (R) are widened to disengage it.

17. Device according to claim 16, characterized in that it further includes a sensor (S) suitable to detect the presence of the grid (G).

18. Device according to claim 15, characterized in that it further includes a sensor (S) suitable to detect the presence of the grid (G).

19. Radiological equipment providing different focal lengths (f1, f2), characterized in that it includes a device for an adjustment of the anti-scattering grid (G) according to claim 1.

* * * * *